US010139107B2

(12) United States Patent
Nakata et al.

(10) Patent No.: US 10,139,107 B2
(45) Date of Patent: Nov. 27, 2018

(54) COMBUSTION CONTROLLING SYSTEM

(71) Applicant: Azbil Corporation, Tokyo (JP)

(72) Inventors: Tomoya Nakata, Tokyo (JP); Yuichi Kumazawa, Tokyo (JP); Katsumi Morikawa, Tokyo (JP)

(73) Assignee: Azbil Corporation, Tokyo (JP)

( * ) Notice: Subject to any disclaimer, the term of this patent is extended or adjusted under 35 U.S.C. 154(b) by 0 days.

(21) Appl. No.: 15/470,149

(22) Filed: Mar. 27, 2017

(65) Prior Publication Data

US 2017/0276353 A1 Sep. 28, 2017

(30) Foreign Application Priority Data

Mar. 28, 2016 (JP) ..... 2016-063546

(51) Int. Cl.
*F23N 5/24* (2006.01)
*F23N 1/00* (2006.01)

(52) U.S. Cl.
CPC ..... *F23N 5/242* (2013.01); *F23N 1/002* (2013.01); *F23N 2023/10* (2013.01); *F23N 2027/02* (2013.01); *F23N 2037/02* (2013.01)

(58) Field of Classification Search
CPC ..... F23N 5/242; F23N 1/002; F23N 2037/02; F23N 2027/02; F23N 2027/28; F23N 5/265; F23N 2023/10; F27D 19/00; F27B 9/40; B60H 1/2206; F23D 2208/00
USPC ..... 431/69
See application file for complete search history.

(56) References Cited

U.S. PATENT DOCUMENTS

2008/0002737 A1* 1/2008 Schwenkel ..... G05B 19/042 370/463
2014/0212821 A1* 7/2014 Banu ..... F23N 5/242 431/6

FOREIGN PATENT DOCUMENTS

JP H11-218034 A 8/1999

* cited by examiner

*Primary Examiner* — Gregory Huson
*Assistant Examiner* — Brandon Nelan
(74) *Attorney, Agent, or Firm* — Oblon, McClelland, Maier & Neustadt, L.L.P.

(57) ABSTRACT

A combustion controlling system according to the present invention provides a signal path for transmitting an ignition preparation signal SA output from a master device to a transmission line through cascade-connected slave devices. Then, each of the slave devices determines whether each of the slave devices outputs the ignition preparation signal to a subsequent device, or not, based on whether there is a flame of the corresponding burner, or not, at the time of igniting the burners, and the master device opens a safety shutoff valve on the condition that an ignition preparation signal SAo has been input from the transmission line.

5 Claims, 10 Drawing Sheets

COMBUSTION CONTROLLING SYSTEM

CROSS-REFERENCE TO RELATED APPLICATION

This application claims priority to Japanese Patent Application No. 2016-063546, filed Mar. 28, 2016. This application is incorporated herein by reference in its entirety.

TECHNICAL FIELD

The present invention relates to a combustion controlling system, and more particularly to a multi-burner system for collectively controlling the supply of a fuel to a plurality of burners with a common safety shutoff valve.

BACKGROUND

In general, in combustion furnaces typified by industrial furnaces such as a steel furnace, a heating furnace and a deodorizing furnace, a combustion control is performed by a combustion controlling system while monitoring a combustion state of a burner disposed in the combustion furnace, a furnace temperature, a pressure of a combustion air, a pressure of a fuel to be supplied to the burner and the like, to thereby ensure the safety of combustion.

For example, in the combustion controlling system, a control is performed so as not to start the ignition operation of the burners when a state in which the flame detector indicates that there is aflame although the flame is not actually present, in other words, a pseudo flame is detected, at the time of igniting the burners, based on the safety standard for industrial combustion furnaces (EN 298: 2012).

As the combustion controlling system, for example, as disclosed in Japanese Unexamined Patent Application Publication No. H11-218034, there is a multi-burner system that controls combustion of a plurality of burners installed in a common combustion chamber. In the present specification, the combustion chamber means a space in which combustion is controlled under a condition (parameter) where a temperature, a pressure or the like is the same, and is also called "zone" below.

In general, the multi-burner system employs a star type device configuration including a burner controller provided corresponding to each burner and a safety controlling device for controlling each burner controller. For that reason, a communication between the respective burner controllers is not performed directly but indirectly through a safety controlling device on an upstream side.

SUMMARY

By the way, in the multi-burner system, in order to realize the safe combustion of the multiple burners, it is particularly important to control the supply of the fuel to the respective burners. Therefore, in the conventional multi-burner system, as a highly safe control technique, a control technique in which a safety shutoff valve is provided for each of branch pipes branched from a main fuel pipe for each burner, and each safety shutoff valve is opened and closed by a corresponding burner controller, to thereby control the supply and shutoff of the fuel to each burner on a burner-by-burner basis.

On the other hand, in recent years, as another technique for controlling the supply of the fuel in the multi-burner system, a control technique in which a single safety shutoff valve common to a main pipeline of the fuel is provided, and the safety shutoff valve is opened and closed by one burner controller that functions as a master, to thereby collectively control the supply and the shutoff of the fuel to each burner at the same time is desired due to an insufficient installation space of equipment such as a safety shutoff valve and economic reasons.

However, in the latter control technique, as will be described below, it has been clarified by the investigation of the present inventors that there is a problem at the time of igniting the burner.

For example, in the former control technique, since the individual burner controllers control the opening and closing of the respective shutoff valves, when the burner controllers detect the pseudo flame at the time of igniting the burners, no fuel is supplied to the burner to be controlled by the burner controller, resulting in a low possibility that the combustion chamber is filled with the uncombusted gas.

On the other hand, in the latter control technique, when the burner controller of the master does not detect the pseudo flame at the time of igniting the burners and the burner controller other than the master detects the pseudo flame, the master burner controller operates the original safety shutoff valve to supply the fuel to the respective burners and start the ignition operation. On the other hand, because the burner that has detected the pseudo flame does not start the ignition operation, an unburned gas flows into the combustion chamber.

In that case, the burner controller that has detected the pseudo flame notifies an upstream safety controlling device that the abnormality has occurred, and the safety controlling device that has received the notification instructs the burner controller of the master to close the safety shutoff valve, to thereby stop the combustion of all the burners.

As described above, a communication between the burner controller that has detected the abnormality and the burner controller of the master is indirectly performed through the safety controlling device, resulting in a problem that the fuel is supplied to the combustion chamber during a period from the detection of the abnormality until the safety shutoff valve is closed, and the amount of unburned gas increases.

For example, when one burner out of four burners has not ignited, the remaining three burners are burning. Therefore, even if an unburned gas for one burner flows into the combustion chamber, there is no problem in safety. However, if only one of the four burners has ignited, because the unburned gas for the remaining three burners flows into the combustion chamber, the amount of unburned gas is increased and there is a concern that the safety is lowered.

The present invention has been made in view of the above problems, and an object of the present invention is to provide a multi-burner system for controlling the supply of a fuel to a plurality of burners by one safety shutoff valve, which improves safety at the time of igniting burners.

A combustion controlling system according to the present invention includes a master device that controls opening and closing of a common safety shutoff valve for collectively switching supply and shutoff of a fuel to a plurality of burners and generates a predetermined signal; a plurality of slave devices that are provided corresponding to the respective burners, determine whether there is a flame in the respective burners, or not, control an ignition of the respective burners, and output the input predetermined signal when it is determined that there is no flame before the ignition of the respective burners, and output no predetermined signal when it is determined that there is the flame before the ignition of the respective burners; and a transmission line that is connected to the master device for transmitting the predetermined signal, wherein the plurality of slave devices are connected in cascade, when all of the plurality of slave devices determine that there is no flame before the ignition of the respective burners, the predetermined signal input to an initial-stage slave device from the master device is sequentially output and output from a final-stage slave device to the transmission line, when any one of the plurality of slave devices determines that there is the flame before the ignition of the corresponding burner, the predetermined signal is not output from the final-stage slave device to the transmission line, and the master device controls the opening and closing of the safety shutoff valve based on whether the predetermined signal is input from the transmission line, or not.

In the combustion controlling system, the transmission line may be commonly connected to each of the slave devices, and the slave device may start ignition of the corresponding burner when receiving a predetermined signal from the transmission line.

The combustion controlling system (101) may further include a burner whose combustion is controlled by the master device, in which the master device outputs no predetermined signal when it is determined that there is a flame of a burner to be controlled before the subject burner is ignited, and outputs the predetermined signal to an initial-stage slave device when it is determined that there is no flame of the burner to be controlled before the subject burner is ignited, and starts the ignition of the burner to be controlled when the predetermined signal is input through the transmission line.

In the above-described combustion controlling system, the master device may include a first flame determining portion that determines whether there is a flame of a burner to be controlled, a signal generating portion that generates and outputs a predetermined signal when it is determined by the first flame determining portion that there is no flame and generates no predetermined signal when it is determined by the first flame determining portion that there is the flame, a first signal detecting portion that detects the input of the predetermined signal from the transmission line, a safety shutoff valve controlling portion that controls the opening and closing of the safety control valve based on the detection result of the first signal detecting portion, and a first ignition controlling portion that controls the ignition of the burner to be controlled based on the determination result of the first flame determining portion.

In the combustion controlling system the slave device may include a second flame determining portion that determines whether there is a flame of the corresponding burner, or not; a signal outputting portion that outputs the input predetermined signal if it is determined that there is no flame by the second flame determining portion and outputs no input predetermined signal if it is determined that there is the flame by the second flame determining portion; a second signal detecting portion that detects the input of the predetermined signal from the transmission line, and a second ignition controlling portion that controls the ignition of the corresponding burner based on a determination result of the second signal detecting portion.

In the above description, as an example, components on the drawings corresponding to components of the present invention are represented by reference numerals in parentheses.

As described above, the present invention can provide the multi-burner system for collectively controlling the supply of the fuel to the plurality of burners by the common safety shutoff valve, which is capable of improving the safety at the time of igniting the burners.

DETAILED DESCRIPTION

Examples of the present invention will be described below with reference to the drawings.

(Configuration of Combustion Controlling System According to an Example)

Figure 1:
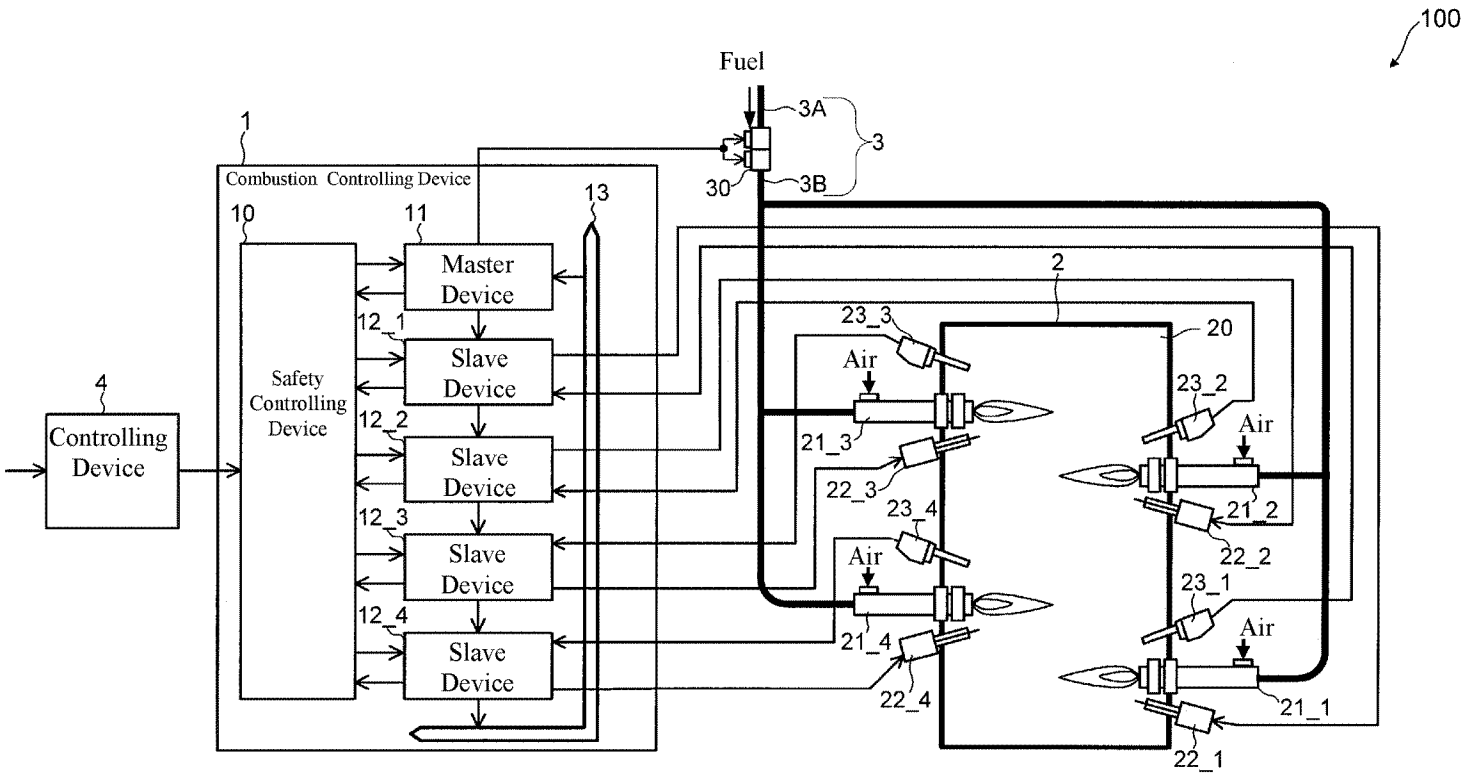
FIG. 1 is a diagram illustrating a configuration of a combustion controlling system according to an example.

FIG. 1 is a diagram illustrating a configuration of a combustion controlling system having a combustion controlling device according to the present example.

A combustion controlling system 100 illustrated in the figure is a multi-burner system. Examples of the combustion controlling system 100 include a system for controlling a small industrial combustion furnace such as a deodorizing furnace and a heating furnace, and a system for controlling a large industrial combustion furnace such as a steel furnace in a plant or the like.

Specifically, the combustion controlling system 100 includes a combustion furnace 2 having one combustion chamber 20, a combustion controlling device 1, a controlling device 4, and a fuel flow channel 3.

The combustion chamber 20 is equipped with n (n is an integer of 2 or more) burners 21_1 to **21_*n*, ignition devices (igniters, IG) 22_1 to 22_*n* provided corresponding to the respective burners 21_1 to 21_*n*, flame detectors (SEN) 23_1 to 23_*n* provided corresponding to the respective burners 21_1 to 21_*n***, and a device necessary for combustion control such as a temperature sensor.

In the present example, n=4 is set as an example, four burners 21_1 to 21_4, four flame detectors 23_1 to 23_4, and four ignition devices 22_1 to 22_4 are provided in the combustion chamber 20. However, the value of "n" is not limited to that value. In FIG. 1, illustration of other devices necessary for the combustion control such as the temperature sensor and the like is omitted.

The burners 21_1 to 21_4 (also simply referred to as "burners 21" in a generic term) are devices that heat an interior of the combustion chamber 20. In the present example, an example will be described in which the burners 21_1 to 21_4 are burners of a direct ignition type directly igniting a main burner without the provision of a pilot burner.

The burners 21_1 to 21_4 are fired by ignition with the use of the ignition devices 22_1 to 22_4 provided corresponding to the respective burners.

The ignition devices 22_1 to 22_4 (also simply referred to as "ignition devices 22" in a generic term) each include, for example, an ignition transformer and an ignition electrode rod (spark rod) connected to a secondary side interconnection of the ignition transformer. The ignition devices 22_1 to 22_4 ignite the respective burners 21_1 to 21_4 by generating a high voltage of, for example, several kV to several tens of kV on the spark rod according to a control signal from the combustion controlling device 1 to be described later.

The flame detectors 23_1 to 23_4 (also simply referred to as "flame detectors 23" in a generic term) are devices that are provided corresponding to the respective burners 21_1 to 21_4, and detect whether there is a flame in the respective burners, or not. The respective flame detectors 23_1 to 23_4 output flame detection signals indicative of whether there is the flame, or not.

The fuel flow channel 3 is a flow path for supplying the fuel to the combustion furnace 2. The fuel flow channel 3 includes a main flow channel 3A to which the fuel is supplied from an outside and a branch flow channel 3B branched into a plurality of flow paths from the main flow channel 3A. A safety shutoff valve 30 is installed in the main flow channel 3A, and the branch flow channel 3B is connected to each of the burners 21_1 to 21_4.

In this case, the fuel may be, for example, gas or oil (liquid), and the fuel type is not particularly limited.

The safety shutoff valve 30 is a device for collectively switching the supply and shutoff of the fuel with respect to the plurality of burners 21_1 to 21_4. When the safety shutoff valve 30 is open, the fuel is delivered from the main flow channel 3A to the branch flow channel 3B, and the fuel is supplied to the respective burners 21_1 to 21_4. When the safety shutoff valve 30 is closed, an inflow of the fuel from the main flow channel 3A to the branch flow channel 3B is shut off, and no fuel is supplied to the burners 21_1 to 21_4.

As illustrated in FIG. 1, for example, the safety shutoff valve 30 has a configuration in which two shutoff valves are used as a set to perform double shutoff, and is disposed at one place in the main flow channel 3A.

Although not shown, the combustion controlling system 100 is provided with an air flow channel for supplying air to the combustion furnace 2 aside from the fuel flow channel 3, and the air discharged from a blower is supplied to the respective burners 21_1 to 21_4 through the air flow channel.

The controlling device 4 is a device on an upstream side in the combustion controlling system 100, for performing a comprehensive control of the combustion furnace 2. The controlling device 4 gives the combustion controlling device 1 an instruction (hereinafter referred to as "combustion request") for combustion in the combustion chamber 20, and a stop request for the operation of the overall combustion furnace 2 according to an input operation from an operator (user) or the like.

As the controlling device 4, a control board integrated with an operation input means for inputting a user's operation such as an operation button, a lever, and a keyboard, a display means for displaying information such as a monitor, and a control means for outputting an instruction and so on to the combustion controlling device 1 can be exemplified. In addition, for example, when a network controlling system in which the combustion controlling device 1, the monitor, a central management device, and the like are connected to each other through a network is configured, the central management device that issues instructions to the combustion controlling device 1 functions as the controlling device 4.

The combustion controlling device 1 is a device for controlling the combustion of the burner 21 in the combustion chamber 20 according to a combustion request from the controlling device 4 or the like. As illustrated in FIG. 1, the combustion controlling device 1 includes a safety controlling device 10, a master device 11, a transmission line 13, a plurality of slave devices 12_1 to **12_*n* cascaded between the master device 11 and the transmission line 13**.

The safety controlling device 10 monitors a combustion state of the burners 21, a state of each limit/interlock (not shown), and so on in order to perform safe operation of the combustion controlling system 100, that is, prevent explosion of the combustion furnace 2, and so on, to thereby instruct the master device 11 and the slave devices 12_1 to 12_4 to permit or refuse the operation of the burners 21 in the combustion chamber 20.

For example, the safety controlling device 10 generates signals indicative of the permission or no permission of the operation of each burner on the basis of a combustion request and a shutoff request of each burner from the controlling portion 4, and flame determination information, abnormality detection information, and so on input from each of the burner controllers 11 and 12_1 to 12_4, and supplies the signals to the master device 11 and the slave devices 12_1 to 12_4. As a result, the safety controlling device 10 controls the operation (the supply and stop of the fuel to the respective burners, etc.) of the respective burners 21_1 to 21_4 through the master device 11 and the slave devices 12_1 to 12_4.

The safety controlling device 10 can be exemplified by a limit interlock module for monitoring a limit interlock manufactured on the basis of safety standard (for example, safety general rules of the industrial combustion furnace JIS B 8415, etc.) related to the industrial combustion furnaces, or a programmable logic controller (so-called safety PLC) that configures a dedicated software complying with the safety general rules.

The master device 11 is a device for controlling the opening and closing of the safety shutoff valve 30.

In a preparatory stage before igniting the burners, the master device 11 generates a predetermined signal and gives the predetermined signal to a cascade-connected initial-stage slave device 12_1. In addition, the master device 11 determines whether the predetermined signal has been returned from the transmission line 13 through the cascade-connected slave devices 12_1 to 12_4, or not, to control the opening and closing of the safety shutoff valve 30. Hereinafter, the master device 11 will be described in detail.

Figure 2:
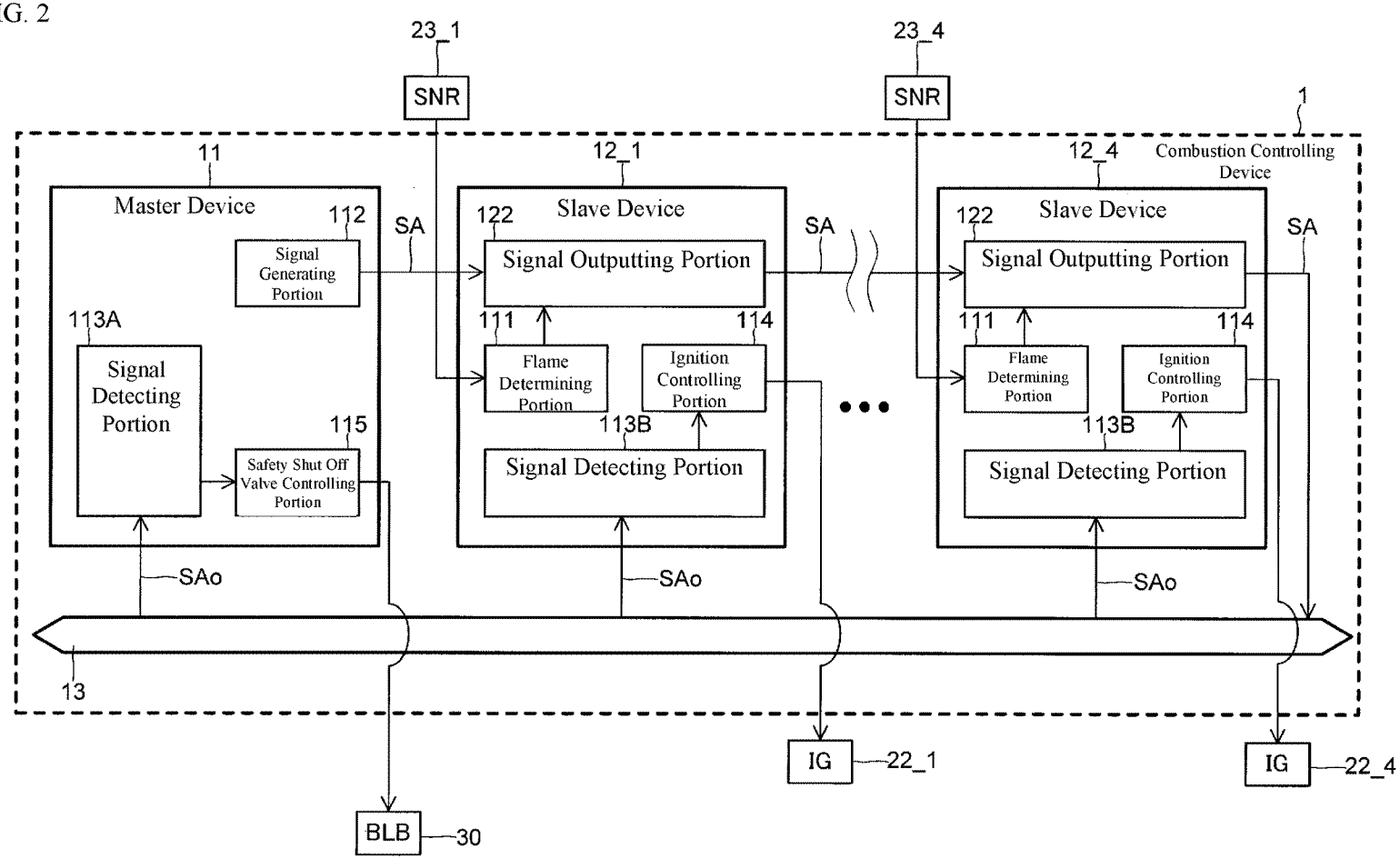
FIG. 2 is a diagram illustrating a configuration of a master device and slave devices in the combustion controlling system according to the example.

FIG. 2 is a diagram illustrating configurations of a master device and slave devices in the combustion controlling system according to the example. In FIG. 2, illustration of the safety controlling device 10 is omitted.

As illustrated in the figure, the master device 11 includes a signal generating portion 112, a signal detecting portion 113A, and a safety shutoff valve controlling portion 115. Those function portions are realized by hardware including, for example, a processor, a clock circuit, a communication circuit, a memory device, a digital input/output circuit, an analog input/output circuit, a power electronics circuit, and a program that operates in cooperation with those hardware.

The signal generating portion 112 is a function portion that generates a predetermined signal. In the present example, a predetermined signal will be described as "ignition preparation signal SA".

For example, upon receiving a combustion request from the safety controlling device 10, the signal generating portion 112 generates the ignition preparation signal SA and supplies the ignition preparation signal SA to the cascade-connected initial-stage slave device 12_1.

In this example, a signal format of the ignition preparation signal SA is not particularly limited. For example, in the present example, it is assumed that the ignition preparation signal SA is a pulse signal, but the ignition preparation signal SA may be a 1-bit signal of high level or low level or a signal of multiple bits.

Although will be described in detail later, the ignition preparation signal SA output from the signal generating portion 112 is input to the transmission line 13 through the cascade-connected slave devices 12_1 to 12_4, and again input to the master device 11 and the respective slave devices 12_1 to 12_4 from the transmission line 13 when the respective slave devices 12_1 to 12_4 satisfy a predetermined condition. In the present example, the ignition preparation signal until output to the transmission line 13 is denoted as "SA", and the ignition preparation signal that has been output to the transmission line 13 is denoted as "SAo".

The signal detecting portion 113A is a function portion that detects the input of the ignition preparation signal SAo from the transmission line 13.

The safety shutoff valve controlling portion 115 controls the opening and closing of the safety shutoff valve 30 based on the detection result of the signal detecting portion 113A. Specifically, when the input of the ignition preparation signal SAo has been detected by the signal detecting portion 113A, the safety shutoff valve controlling portion 115 determines that preparation for ignition of all the slave devices 12_1 to 12_4 has been completed and opens the safety shutoff valve 30. On the other hand, when the input of the ignition preparation signal SAo has not been detected by the signal detecting portion 113A, the safety shutoff valve controlling portion 115 determines that preparation for ignition of at least one of the slave devices 12_1 to 12_4 has not been completed, and closes the safety shutoff valve 30.

The transmission line 13 is a line that is commonly connected to each of the master device 11 and the slave devices 12_1 to 12_4 for transmitting the ignition preparation signal SA. The transmission line 13 may have a configuration capable of transmitting the ignition preparation signal SA to a plurality of devices. For example, when the ignition preparation signal SA is a pulse signal as described above, the transmission line 13 may be configured by a dedicated line for 1 bit transmission, or when the ignition preparation signal SA is a multi-bit signal, the transmission line 13 may be a bus having a plurality of signal lines.

The slave devices 12_1 to 12_4 (also simply referred to as "slave devices 12" in a general term) are burner controllers that are provided corresponding to the respective burners 21_1 to 21_4, determine whether there is a flame of the respective burners, or not, and controls the ignition of the respective burners based on the ignition preparation signal SAo input from the transmission line 13. Each of the slave devices 12_1 to 12_4 is connected in cascade between the master device 11 and the transmission line 13 so as to provide a signal path for transmitting the ignition preparation signal SA output from the master device 11 to the transmission line 13.

As illustrated in FIG. 2, each of the slave devices 12 includes a flame determining portion 111, a signal outputting portion 122, the signal detecting portion 113A, and an ignition controlling portion 114. For example, those function portions are realized by hardware including, for example, a processor, a clock circuit, a communication circuit, a memory device, a digital input/output circuit, an analog input/output circuit, a power electronics circuit, and a program that operates in cooperation with those hardware.

The flame determining portion 111 determines whether a stable flame is generated by the corresponding burner, or not, based on the flame detection signal output from a corresponding one of the flame detectors 23_1 to 23_4. For example, when a flame detection signal indicating that a flame is present is output from a corresponding one of the flame detectors 23_1 to 23_4 during the combustion in the combustion furnace 2, the flame determining portion 111 determines that a stable flame occurs by the corresponding burner. On the other hand, if a flame detection signal indicating that there is no flame is output during the combustion in the combustion furnace 2, the flame determining portion 111 determines that the corresponding burner is subjected to a flame failure. Also, in a preparation period before the ignition of the burner is started, when the flame detector outputs a flame detection signal indicating that there is a flame in spite of the fact that there is no flame, the flame determining portion 111 determines that a pseudo flame is occurring. The determination result of the flame determining portion 111 is output to the signal outputting portion 122 and also output to the safety controlling device 10.

The signal outputting portion 122 is a function portion for outputting the ignition preparation signal SA input from an outside (the master device 11 or another slave device) to a subsequent device (the slave device or the transmission line 13) based on the determination result of the flame determining portion 111. Specifically, when it is determined by the flame determining portion 111 that there is no flame of the burner 21 before igniting the corresponding burner 21, the signal outputting portion 122 outputs the input ignition preparation signal SA to the subsequent device, and when it is determined by the flame determining portion 111 that there is a flame (pseudo flame) of the burner 21 before igniting the corresponding burner 21, the signal outputting portion 122 does not output the input ignition preparation signal SA to the subsequent device.

As the signal outputting portion 122, a switch circuit that includes a switch element whose one end is connected to a preceding device (the master device 11 or the slave device 12) and the other end is connected to the subsequent device (the slave device 12 or the transmission line 13), and turns on/off the switch element based on the determination result of the flame determining portion 111 can be exemplified.

Therefore, when it is determined that there is no flame before the ignition of the respective the burners 21_1 to 21_3, the slave devices 12_1 to 12_3 excluding the cascade-connected final-stage slave device 12_4 output the input ignition preparation signal SA to the slave devices 12_2 to 12_4 connected to the respective subsequent slave devices by the signal outputting portion 122. When it is determined that there is a flame before the ignition of the respective burners 21_1 to 21_3, the slave devices 12_1 to 12_3 output no input ignition preparation signal SA to the slave devices 12_2 to 12_4 connected to the respective subsequent slave devices.

When the slave device 12_4 at the final stage determines that there is no flame before the corresponding burner 21_4 is ignited, the signal outputting portion 122 outputs the input ignition preparation signal SA to the transmission line 13. When the slave device 12_4 determines that there is a flame before the corresponding burner 21_4 is ignited, the signal outputting portion 122 outputs no input ignition preparation signal SA to the transmission line 13.

As with the signal detecting portion 113A, a signal detecting portion 113B is a function portion that detects the input of the ignition preparation signal SAo from the transmission line 13.

The ignition controlling portion 114 is a function portion that controls the ignition of the corresponding burner based on the detection result of the signal detecting portion 113B. Specifically, when the signal detecting portion 113B detects the input of the ignition preparation signal SAo, the ignition controlling portion 114 ignites the corresponding respective burners 21_1 to 21_4 by controlling the respective ignition device 22_1 to 22_4 according to, for example, a predetermined ignition sequence.

(Operation of Combustion Controlling System According to the Example)

Next, the operation of the combustion controlling system 100 at the time of igniting the burners will be described with reference to the drawings.

Figure 3:
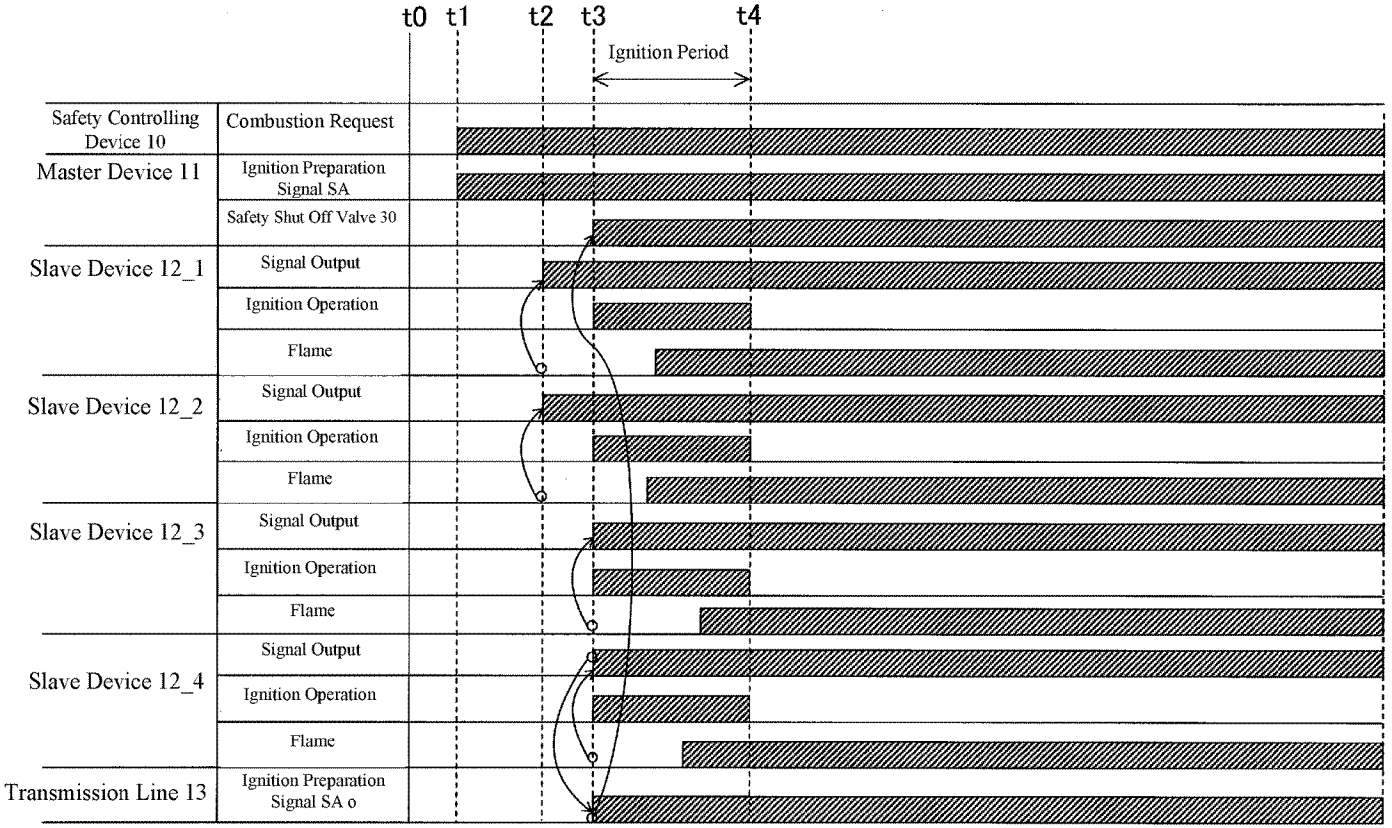
FIG. 3 is a diagram illustrating an operation flow of the combustion controlling system in the case where the burners are ignited and all of the burners have been fired according to the example.
Figure 4:
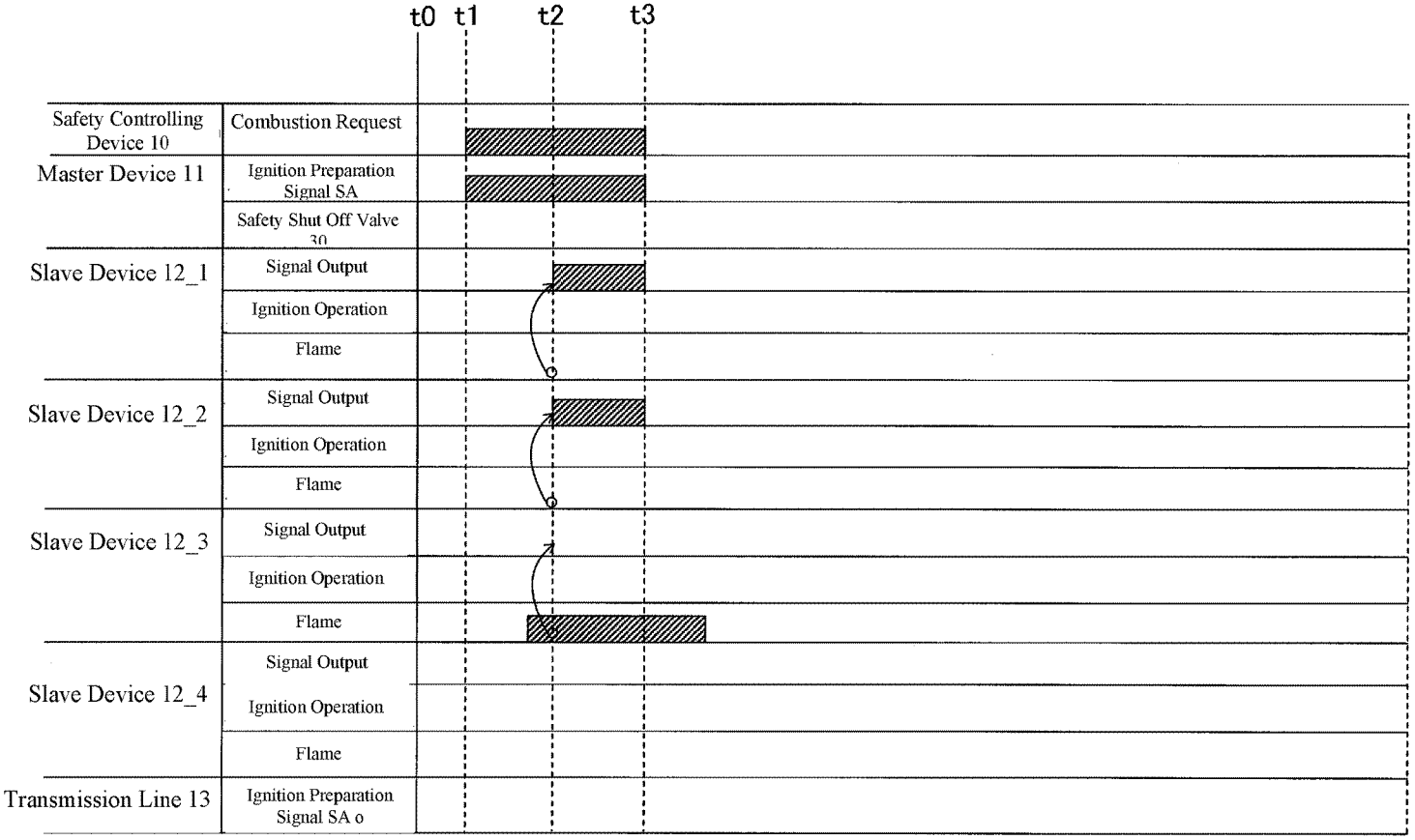
FIG. 4 is a diagram illustrating an operation flow of the combustion controlling system in the case where one or some of the burners detect a pseudo flame and the ignition of the burner could not be started according to the example.

FIG. 3 is a diagram illustrating an operation flow of the combustion controlling system 100 in the case where the burners are ignited and all of the burners are fired. FIG. 4 is a diagram illustrating an operation flow of the combustion controlling system 100 in the case where one or some of the burners are detected as a pseudo flame and the ignition of the burners could not been started. FIGS. 5A to 5F are diagrams illustrating the operating states of the master device 11 and the slave devices under the ignition control of the burners and the transmission states of the ignition preparation signal SA.

In FIGS. 3 and 4, a period during which the combustion request is output, a period during which the ignition preparation signals SA and SAo are output, a period during which the safety shutoff valve 30 is open, and a period during which the flame is occurring are indicated by hatching.

First, a flow of the operation of the combustion controlling system 100 in the case where burners are ignited and all of the burners are fired will be described.

As illustrated in FIG. 3, it is assumed that the combustion controlling system 100 is activated, for example, at a time t0. At this time, the master device 11 closes the safety shutoff valve 30, and the slave devices 12_1 to 12_4 enter a standby state (refer to FIG. 5A).

Next, it is assumed that at a time t1, the controlling device 4 outputs a combustion instruction of the combustion chamber 20 to the combustion controlling device 1. In this case, the safety controlling device 10 in the combustion controlling device 1 that has received the instruction from the controlling device 4 performs, for example, a prepurge in the combustion chamber 20, and outputs the combustion requests to the master device 11 and each of the slave devices 12.

Next, upon receiving the combustion request, the master device 11 outputs the ignition preparation signal SA by the signal generating portion 112 in a state where the safety shutoff valve 30 is closed. On the other hand, upon receiving the combustion request, the slave device 12 starts preparation for ignition (refer to FIG. 5B). Specifically, the slave device 12 determines whether there is a pseudo flame, or not, based on the flame detection signal from the corresponding flame detector 23 as one of ignition preparations.

Thereafter, for example, at a time t2, it is assumed that the slave devices 12_1 and 12_2 determine that there are no flame (pseudo flame) of the corresponding respective burners 21_1 and 21_2. In that case, the slave device 12_1 outputs the ignition preparation signal SA input from the master device 11 to the subsequent slave device 12_2 and the slave device 12_2 outputs the ignition preparation signal SA supplied from the slave device 12_1 to the slave device 12_3 at the subsequent stage (refer to FIG. 5C). At that time, since the slave devices 12_3 and 12_4 are in preparation for ignition, the ignition preparation signal SA is not transmitted to the transmission line 13.

Next, for example, at a time t3, it is assumed that the slave devices 12_3 and 12_4 determine that there are no flame (pseudo flame) of the corresponding respective burners 21_3 and 21_4. In that case, the slave device 12_3 outputs the ignition preparation signal SA input from the slave device 12_2 to the subsequent slave device 12_4 and the slave device 12_4 outputs the ignition preparation signal SA supplied from the slave device 12_3 to the transmission line 13 at the subsequent stage. As a result, the ignition preparation signal SAo is input from the transmission line 13 to the master device 11 and the slave devices 12_1 to 12_4 respectively (refer to FIG. 5D).

Upon detecting the input of the ignition preparation signal SAo, the master device 11 opens the safety shutoff valve 30. Upon receiving the input of the ignition preparation signal SAo, the slave devices 12_1 to 12_4 start the ignition of the burners according to a predetermined ignition sequence (refer to FIG. 5E).

In this case, the period during which the ignition operation is performed is referred to as an ignition period (ignition trial period). Meanwhile, in the present example, as an example, it is assumed that the ignition period is identical with a maximum allowable time at which the supply of the fuel to the burner 21 is permitted in the absence of flame, that is, a safety time (JIS B 0113).

When the flames of all the burners 21 are detected after the ignition period has elapsed, it is determined that each burner has normally ignited, and the combustion in the combustion furnace 2 is continued.

Next, a flow of the operation of the combustion controlling system 100 in the case where one or some of the burners are detected as a pseudo flame and the ignition of the burners could not been started will be described with reference to FIG. 4.

Figure 5A:
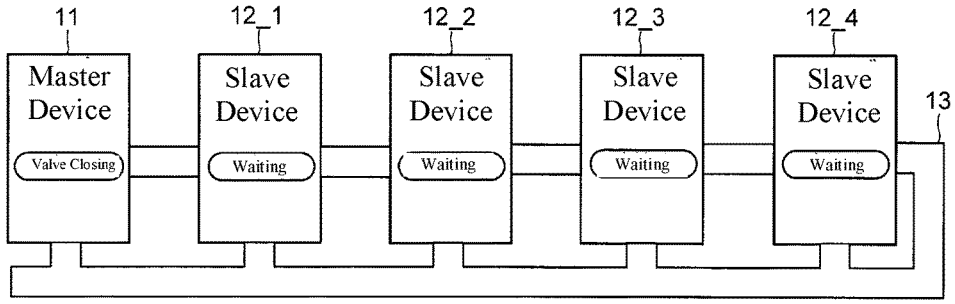
FIG. 5A is a diagram illustrating operating states of the master device and the slave devices and a transmission state of an ignition preparation signal when the burners are ignited.
Figure 5B:
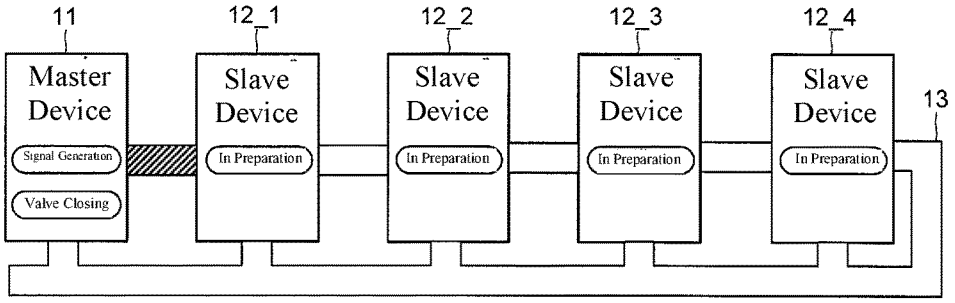
FIG. 5B is a diagram illustrating the operating states of the master device and the slave devices and the transmission state of the ignition preparation signal when the burners are ignited.
Figure 5C:
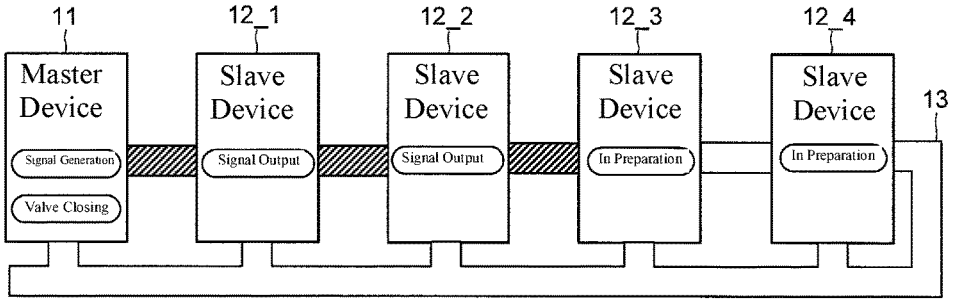
FIG. 5C is a diagram illustrating the operating states of the master device and the slave devices and the transmission state of the ignition preparation signal when the burners are ignited.
Figure 5D:
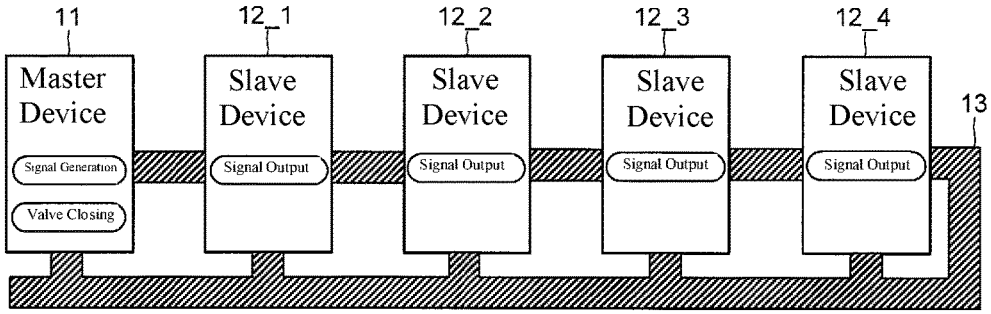
FIG. 5D is a diagram illustrating the operating states of the master device and the slave devices and the transmission state of the ignition preparation signal when the burners are ignited.
Figure 5E:
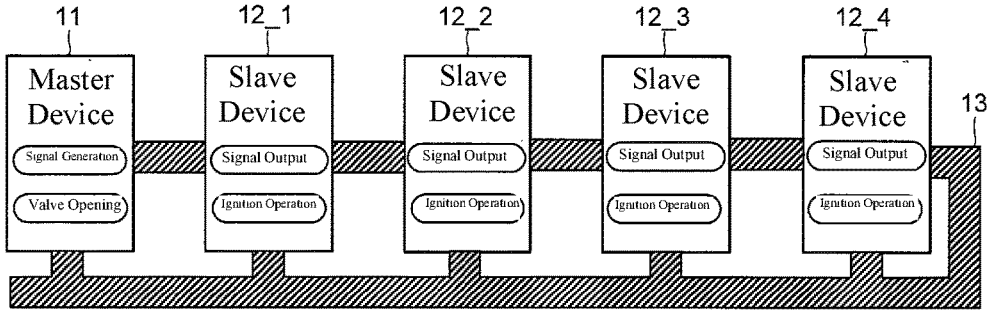
FIG. 5E is a diagram illustrating the operating states of the master device and the slave devices and the transmission state of the ignition preparation signal when the burners are ignited.
Figure 5F:
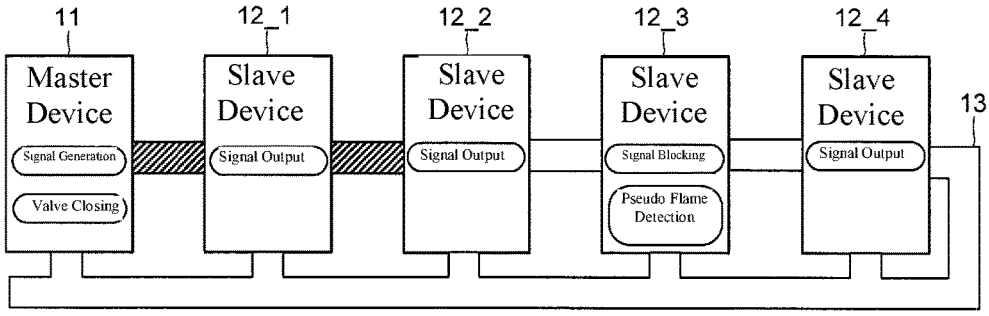
FIG. 5F is a diagram illustrating the operating states of the master device and the slave devices and the transmission state of the ignition preparation signal when the burners are ignited.

As with the operation flow of FIG. 3 described above, the combustion request is input to the master device 11 and each slave device 12 at the time t1. At this time, for example, as illustrated in FIG. 4, it is assumed that a pseudo flame of the burner 21_3 which is an object to be controlled by the slave device 12_3 is detected. In this case, the signal outputting portion 122 of the slave device 12_3 does not output the ignition preparation signal SA to the subsequent slave device 12_4 even when receiving the ignition preparation signal SA. For that reason, as illustrated in FIG. 4, even if the slave devices 12_1, 12_2, and 12_4 do not detect the pseudo flame, for example at a time t2, the ignition preparation signal SA is not transmitted to the transmission line 13 (FIG. 5F). As a result, since the master device 11 does not detect the ignition preparation signal SAo from the transmission line 13, the safety shutoff valve 30 is maintained in a closed state, and no fuel flows into the combustion chamber 20. In addition, since the slave devices 12_1 to 12_4 do not detect the ignition preparation signal SAo from the transmission line 13, the ignition operation is not started. Thereafter, for example, at a time t3, the slave device 12_3 that has detected the pseudo flame notifies the safety controlling portion 10 that the pseudo flame has been detected, to thereby allow the combustion request from the safety controlling portion 10 to the master device 11 and the slave devices 12_1 to 12_4 to be withdrawn, and the master device 11 and the slave devices 12_1 to 12_4 enter a standby state or a locked-out state.

(Advantages of Combustion Controlling System According to the Example)

As described above, according to the combustion controlling system of the present invention, even if the pseudo flame of one of the burners has been detected when the plurality of burners are ignited, the combustion chamber is prevented from being filled with the unburnt gas with the result that the safety of the combustion furnace can be improved.

In other words, the combustion controlling system according to the example provides a signal path for transmitting the ignition preparation signal SA output from the master device 11 to the transmission line 13 through the cascade-connected slave devices 12_1-12_4. Then, each of the slave devices 12_1 to 12_4 determines whether each of the slave devices 12_1-12_4 outputs the ignition preparation signal SA to a subsequent device, or not, based on whether there is a flame of the corresponding burner, or not, at the time of igniting the burners 21_1 to 21_4, and the master device 11 opens the safety shutoff valve 30 on the condition that the ignition preparation signal SAo has been input from the transmission line 13. Therefore, even when the pseudo flame has been detected in any one of the burners 21 at the time of ignition, the fuel does not flow into the combustion chamber 20, and the safety of the combustion furnace 2 at the time of burner ignition can be improved.

Further, according to the combustion controlling system of the example, since the ignition of each burner 21 is started on the condition that the corresponding slave device 12 receives the ignition preparation signal SAo from the transmission line 13, the simultaneous ignition of all the burners 21 can be easily realized.

Another Example (Configuration of Combustion Controlling System According to Another Example)

Figure 6:
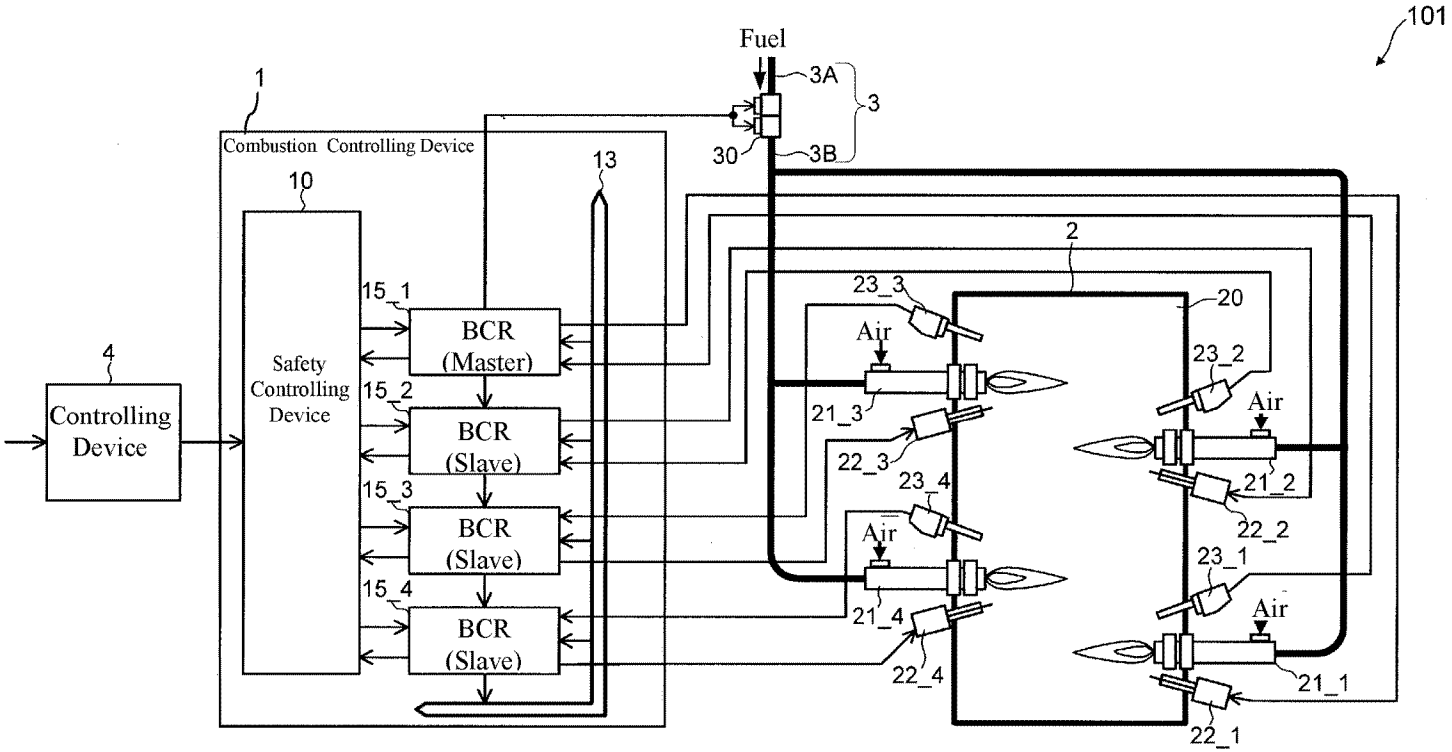
FIG. 6 is a diagram illustrating a configuration of a combustion controlling system according to another example.

FIG. 6 is a diagram illustrating a configuration of a combustion controlling system according to another example.

A combustion controlling system 101 illustrated in FIG. 6 differs from the combustion controlling system 100 according to the previous example in that one of the plurality of burner controllers functions as a master device for controlling the opening and closing of the safety shutoff valve.

Specifically, the combustion controlling system 101 has a plurality of burner controllers (BCR) 15_1 to 15_4 provided corresponding to the respective burners 21_1 to 21_4. The burner controller 15_1 functions as a master device for controlling the combustion of the corresponding burner, for generating the ignition preparation signal SA, and for controlling the safety shutoff valve 30, and the burner controllers 15_2 to 15_4 function as slave devices for controlling combustion of the corresponding respective burners 21_1 to 21_4.

Figure 7:
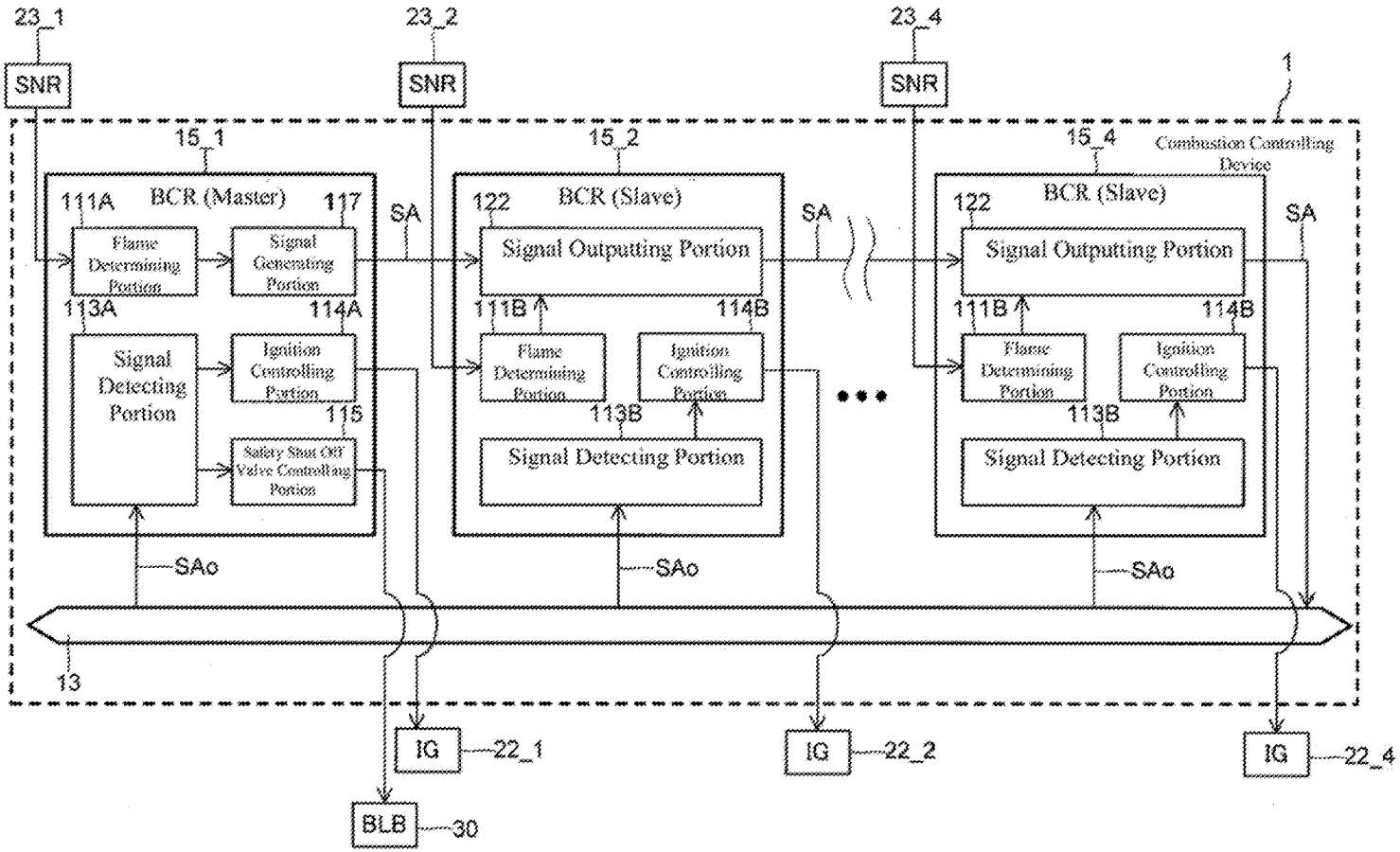
FIG. 7 is a diagram illustrating a configuration of a master device and a slave device in the combustion controlling system according to the other example.

FIG. 7 is a diagram illustrating an internal configuration of a burner controller in the combustion controlling system according to the other example.

Among the components of the combustion controlling system 101 according to the other example, the same components as in the combustion controlling system 100 according to the above example are designated by the same reference numerals and their detailed description will be omitted.

In the second example, for convenience of description, a flame determining portion and an ignition controlling portion of the burner controller 15_1 as the master device are denoted with reference numerals "111A" and "114A", and frame determining portions and ignition controlling portions of the burner controllers 15_2 to 15_4 as the slave devices are denoted by reference numerals "111B" and "114B".

As illustrated in FIG. 7, the burner controller 15_1 functioning as the master device includes a first flame determining portion 111A, a signal generating portion 117, the signal detecting portion 113A, the ignition controlling portion 114, and a safety shutoff valve controlling portion 115.

The first flame determining portion 111A determines whether a stable flame is generated by the burner 21_1, or not, based on the flame detection signal output from the flame detector 23_1. The flame determination method by the first flame determining portion 111A is similar to the flame determining portion 111 according to the above example. The determination result of the flame determining portion 111A is output to the signal generating portion 117 and also output to the safety controlling device 10.

The signal generating portion 117 generates the ignition preparation signal SA based on the determination result of the first flame determining portion 111A. Specifically, when it is determined by the first flame determining portion 111A that there is no flame (pseudo flame) of the burner 21_1, the signal generating portion 117 generates the ignition preparation signal SA and outputs the generated ignition preparation signal SA to the burner controller 15_2. When it is determined by the first flame determining portion 111A that there is the flame (pseudo flame) of the burner 21_1, the signal generating portion 117 generates no ignition preparation signal SA.

The ignition controlling portion 114A is a function portion that controls the ignition of the burner 21_1 based on the detection result of the signal detecting portion 113A. Specifically, when the signal detecting portion 113A detects the input of the ignition preparation signal SAo, the ignition controlling portion 114A ignites the burner 21_1 by controlling the ignition device 22_1 according to, for example, a predetermined ignition sequence.

As with the slave devices 12_2 to 12_4 in the example, each of the burner controllers 15_2 to 15_4 includes the signal outputting portion 122, the second flame determining portion 111B, the signal detecting portion 113B, and the ignition controlling portion 114B. The second flame determining portion 111B and the ignition controlling portion 114B have the same configuration as the flame determining portion 111 and the ignition controlling portion 114 in the example.

(Operation of Combustion Controlling System According to the Other Example)

Next, the operation of the combustion controlling system 101 during ignition control of the burner will be described with reference to the drawings.

Figure 8:
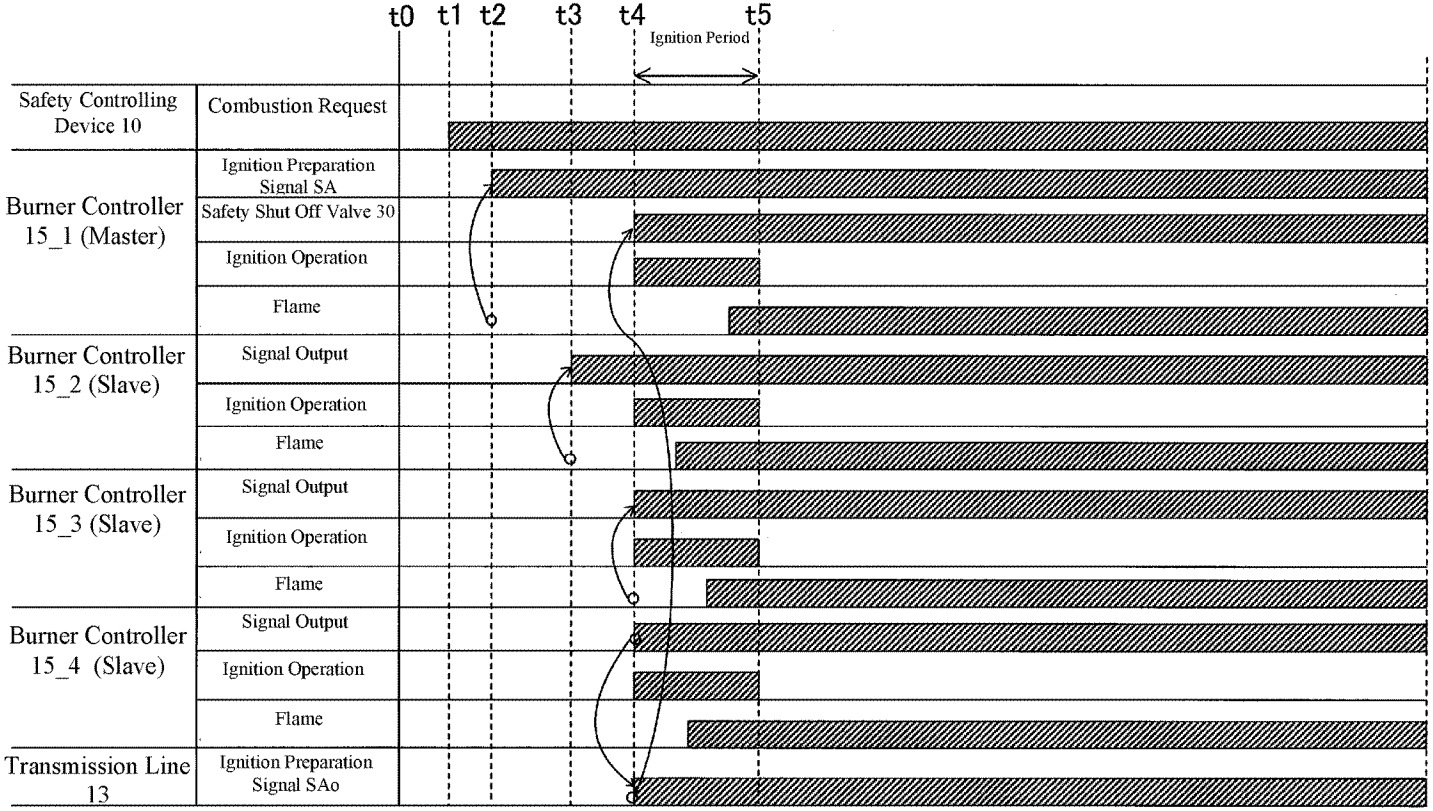
FIG. 8 is a diagram illustrating an operation flow of the combustion controlling system in the case where the burners are ignited and all of the burners have been fired according to the other example.
Figure 9:
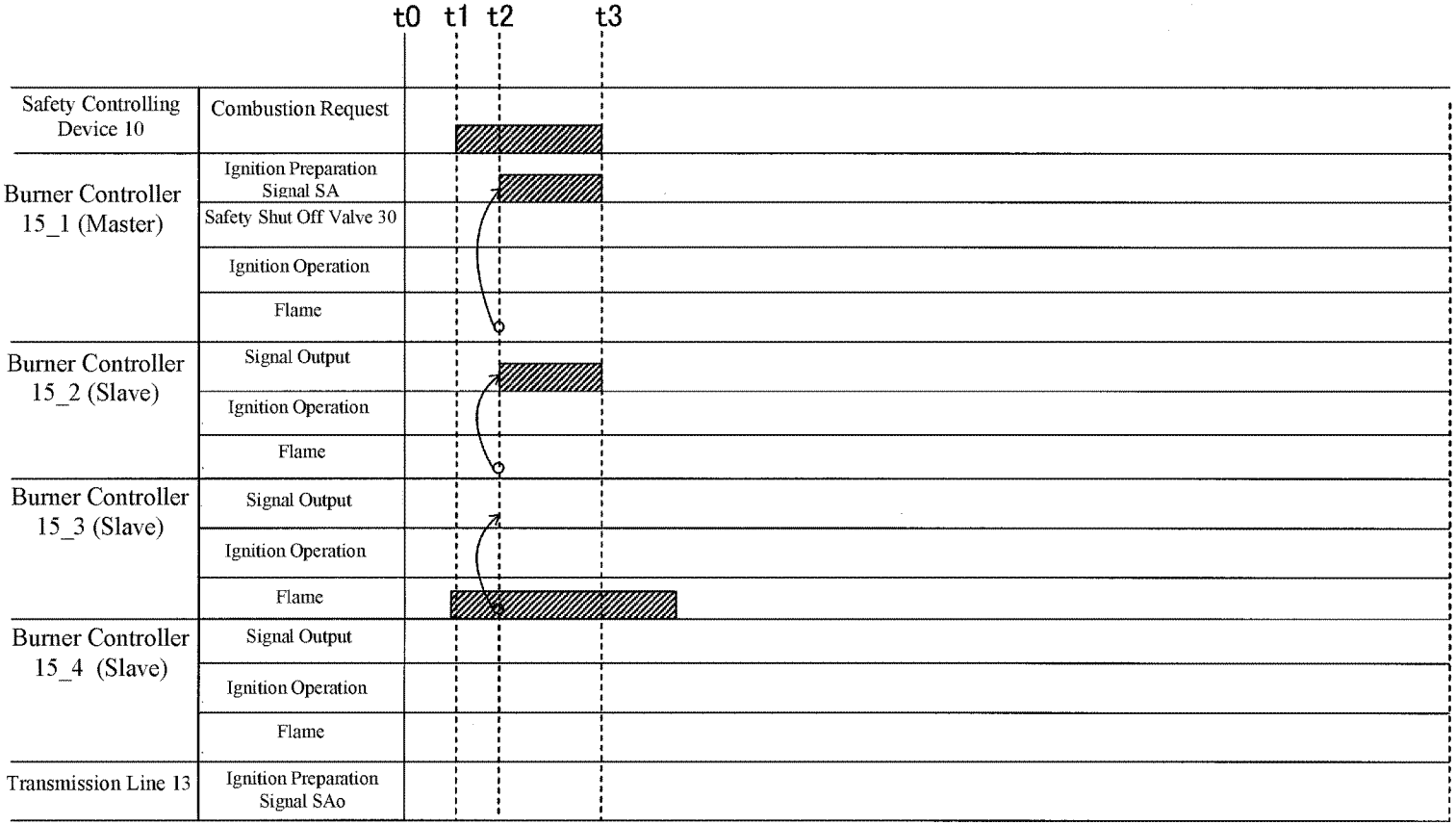
FIG. 9 is a diagram illustrating an operation flow of the combustion controlling system in the case where one or some of the burners are detected as a pseudo flame and the ignition of the burners could not been started according to the other example.

FIG. 8 is a diagram illustrating an operation flow of the combustion controlling system 101 in the case where all of the burners have been fired by ignition control of the burner. FIG. 9 is a diagram illustrating an operation flow of the combustion controlling system 101 in the case where one or some burners have not normally been fired under an ignition control of the burners.

First, a flow of the operation of the combustion controlling system 101 in the case where all of the burners have been fired will be described.

As illustrated in FIG. 8, it is assumed that the combustion controlling system 101 is activated, for example, at a time to. At this time, the burner controller 15_1 as the master device closes the safety shutoff valve 30, and the slave devices 15_2 to 15_4 enter a standby state.

Next, it is assumed that at a time t1, the controlling device 4 outputs a combustion instruction of the combustion chamber 20 to the combustion controlling device 1. In this case, the safety controlling device 10 in the combustion controlling device 1 that has received the instruction from the controlling device 4 performs, for example, a prepurge in the combustion chamber 20, and outputs the combustion request to the respective burner controllers 15_1 to 15_4.

Next, upon receiving the combustion request, the burner controller 15_1 starts preparation for ignition in a state where the safety shutoff valve 30 is closed. Specifically, the burner controller 15_1 determines whether there is the pseudo flame of the burner 21_1, or not, based on the flame detection signal from the flame detector 23_1 as the ignition preparation. When it is determined that there is no pseudo flame of the burner 21_1 as a result of the determination, for example, at a time t2, the signal generating portion 117 generates the ignition preparation signal SA and gives the ignition preparation signal SA to the burner controller 15_2 at the subsequent stage. Meanwhile, when it is determined that there is the pseudo flame of the burner 21_1, the signal generating portion 117 generates no ignition preparation signal SA, but notifies, for example, the safety controlling device 10 of the fact that the pseudo flame has been detected.

Next, upon receiving the combustion request, the burner controllers 15_2 to 15_4 as the slave devices start preparation for ignition. Specifically, the burner controllers 15_2 to 15_4 determine whether there is the pseudo flame, or not, based on the flame detection signal from the corresponding flame detector 23 as the ignition preparation.

Thereafter, for example, at a time t3, it is assumed that the burner controller 15_2 determines that there is no flame (pseudo flame) of the burner 21_2. In that case, the burner controller 15_2 outputs the ignition preparation signal SA input from the burner controller 15_1 to the burner controller 15_3 at the subsequent stage. At that time, since the burner controllers 15_3 and 15_4 are in preparation for ignition, the ignition preparation signal SA is not transmitted to the transmission line 13.

Thereafter, at a time t4 when it is determined that there is no flame (pseudo flame) of all the burners 21_1 to 21_4, the ignition preparation signal SA output from the burner controller 15_1 is transmitted to the transmission line 13 through the burner controllers 15_2 to 15_4.

Upon detecting the input of the ignition preparation signal SAo from the transmission line 13, the burner controller 15_1 opens the safety shutoff valve 30 and starts ignition of the burner 21_1 according to a predetermined ignition sequence. In addition, upon detecting the input of the ignition preparation signal SAo from the transmission line 13, the burner controllers 15_2 to 15_4 start the ignition of the corresponding respective burners 21_2 to 21_4 according to a predetermined ignition sequence.

If the flame of each burner is detected after a predetermined ignition period has elapsed, it is determined that each burner has normally being fired, and the combustion in the combustion furnace 2 is continued.

Next, a flow of the operation of the combustion controlling system 101 in the case where one or some of the burners have not been normally fired will be described with reference to FIG. 9.

As with the operation flow of FIG. 8 described above, at a time t1, the combustion request is input to each of the burner controller 15_1 and the burner controllers 15_2 to 15_4, and at a time t2, the burner controller 15_1 does not detect the pseudo flame, and outputs the ignition preparation signal SA.

At that time, for example, as illustrated in FIG. 9, it is assumed that the pseudo flame of the burner 21_3 which is an object to be controlled by the burner controller 15_3 is detected. In that case, the signal outputting portion 122 of the burner controller 15_3 does not output the ignition preparation signal SA to the subsequent burner controller 15_4 even when receiving the ignition preparation signal SA. For that reason, as illustrated in FIG. 9, for example, even if the burner controller 15_2 does not detect the pseudo flame at the time t3 and the burner controller 15_4 does not detect the pseudo flame at the time t4, the ignition preparation signal SA is not transmitted to the transmission line 13. As a result, since the burner controller 15_1 does not detect the ignition preparation signal SAo from the transmission line 13, the safety shutoff valve 30 is maintained in the closed state and the fuel does not flow into the combustion chamber 20.

(Advantages of Combustion Controlling System According to the Other Example)

As described above, according to the combustion controlling system 101 according to the other example, as with the combustion controlling system 100 according to the previous example, the safety of the combustion furnace at the time of igniting the plurality of burners can be improved.

Further, according to the combustion controlling system 101, the burner controller corresponding to each burner is provided, and one of the burner controllers is made to function as a master device for controlling the opening and closing of the safety shutoff valve, as a result of which with a simpler device configuration, the safety of the combustion furnace can be improved.

As described above, the invention implemented by the inventors and the like has been described specifically based on the example. However, the invention is not limited to the example and it will be appreciated that various modifications can be made without departing from the scope of the invention.

For example, in the above examples, the cases where the combustion furnace 2 of the combustion controlling systems 100 and 101 has one combustion chamber 20 have been exemplified. Alternatively, a plurality of combustion chambers may be provided. In that case, the main flow channel 3A, the branch flow channel 3B, the safety shutoff valve 30, and the combustion controlling device 1 may be provided for each combustion chamber, and each of the combustion controlling devices 1 may control the opening and closing of the corresponding safety shutoff valve 30.

In addition, in the above examples, the cases in which the burners 21_1 to 21_4 are burners of the direct ignition type which directly ignite the main burner without the provision of the pilot burner. Alternatively, the burners 21_1 to 21_4 may be configured by a burner of a timed pilot ignition type having the pilot burner and the main burner.

What is claimed is:

1. A combustion controlling system comprising:

a master device that controls opening and closing of a common safety shutoff valve collectively switching supply and shutoff of a fuel to a plurality of burners and generates a predetermined signal;

a plurality of slave devices that are provided corresponding to the respective burners, the plurality of slave devices configured to determine whether there is a flame in the corresponding respective burners, control an ignition of the corresponding respective burners, and output the input predetermined signal when it is determined that there is no flame before the ignition of the corresponding respective burners, and output no predetermined signal when it is determined that there is the flame before the ignition of the corresponding respective burners; and a transmission line connected to the master device for transmitting the predetermined signal, wherein the plurality of slave devices are connected in cascade, when all of the plurality of slave devices determine that there is no flame before the ignition of the corresponding respective burners, the predetermined signal input to an initial-stage slave device of the plurality of slave devices from the master device is sequentially output and output from a final-stage slave device of the plurality of slave devices to the transmission line, when any one of the plurality of slave devices determines that there is the flame before the ignition of the corresponding burner, the predetermined signal is not output from the final-stage slave device to the transmission line, and the master device controls the opening and closing of the safety shutoff valve based on whether the predetermined signal transmitted through the transmission line is input.

2. The combustion controlling system according to claim 1, wherein the plurality of slave devices are commonly connected to the transmission line, and each of the plurality of slave device starts ignition of the corresponding respective burner when receiving the predetermined signal from the transmission line.

3. The combustion controlling system according to claim 2, further comprising a burner of the plurality of burners whose combustion is controlled by the master device, wherein the master device outputs no predetermined signal when it is determined that there is a flame of the burner to be controlled before the subject burner is ignited, and outputs the predetermined signal to the initial-stage slave device when it is determined that there is no flame of the burner to be controlled before the subject burner is ignited, and starts the ignition of the burner to be controlled when the predetermined signal is input through the transmission line.

4. The combustion controlling system according to claim 3, wherein the master device comprises:

a first flame determiner that determines whether there is a flame of the burner to be controlled;

a signal generator generates and outputs the predetermined signal when it is determined by the first flame determiner that there is no flame and generates no predetermined signal when it is determined by the first flame determiner that there is the flame;

a first signal detector detects the input of the predetermined signal from the transmission line;

a safety shutoff valve controller controls the opening and closing of the safety control valve based on the detection result of the first signal detecting portion; and a first ignition controller controls the ignition of the burner to be controlled based on the determination result of the first flame determining portion.

5. The combustion controlling system according to claim 4, wherein each of the plurality of slave devices comprise:

a second flame determiner determines whether there is a flame of the corresponding respective burner;

a signal output outputs the predetermined signal if it is determined that there is no flame by the second flame determiner and outputs no input predetermined signal if it is determined that there is the flame by the second flame determiner;

a second signal detector detects the input of the predetermined signal from the transmission line; and a second ignition controller controls ignition of the corresponding burner based on a detection result of the second signal detecting portion.

* * * * *